US007901757B2

(12) United States Patent
Strout et al.

(10) Patent No.: US 7,901,757 B2
(45) Date of Patent: Mar. 8, 2011

(54) MOLDED PLASTIC PANEL

(76) Inventors: Corwyn Strout, Lee's Summit, MO (US); Claude Brown, Jr., Gibsonia, PA (US); David Jacobson, Sewickley, PA (US); Wayne Moore, Frankfurt, KY (US); Monty Cochrane, Cumming, GA (US)

( * ) Notice: Subject to any disclaimer, the term of this patent is extended or adjusted under 35 U.S.C. 154(b) by 732 days.

(21) Appl. No.: 11/559,841

(22) Filed: Nov. 14, 2006
(Under 37 CFR 1.47)

(65) Prior Publication Data

US 2008/0185745 A1 Aug. 7, 2008

Related U.S. Application Data

(60) Provisional application No. 60/738,282, filed on Nov. 18, 2005.

(51) Int. Cl.
*B32B 3/24* (2006.01)

(52) U.S. Cl. ..... 428/131; 52/527; 52/538; 52/535; 52/542; 52/531; 52/545; 52/521

(58) Field of Classification Search ..... 428/131; 52/521, 527, 538, 535, 542, 531, 545
See application file for complete search history.

(56) References Cited

U.S. PATENT DOCUMENTS

| | | | | |
|---|---|---|---|---|
| 3,862,532 | A * | 1/1975 | Markos | 52/521 |
| 3,973,369 | A * | 8/1976 | Smith | 52/526 |
| 4,034,528 | A * | 7/1977 | Sanders et al. | 52/309.4 |
| 5,347,784 | A * | 9/1994 | Crick et al. | 52/520 |
| 6,161,354 | A * | 12/2000 | Gilbert et al. | 52/520 |
| 6,224,701 | B1 * | 5/2001 | Bryant et al. | 156/73.1 |
| 6,341,463 | B1 * | 1/2002 | Dickey et al. | 52/521 |
| 6,363,676 | B1 * | 4/2002 | Martion, III | 52/519 |
| 2007/0090570 | A1 * | 4/2007 | Cochran et al. | 264/318 |

* cited by examiner

*Primary Examiner* — William P Watkins, III
(74) *Attorney, Agent, or Firm* — Lathrop & Gage LLP

(57) ABSTRACT

A molded panel for buildings is manufactured in a manner that permits the blocking tab along the upper edge of the panel to be molded in a position that is close to its final desired position. Pressure is applied to the locking tab as it cools, thereby bringing the locking tab into its final position.

10 Claims, 4 Drawing Sheets

MOLDED PLASTIC PANEL

This application claims the benefit of the filing date of a provisional application Ser. No. 60/738,282 which was filed on Nov. 18, 2005.

BACKGROUND OF THE INVENTION

1. Field of the Invention

The present invention relates to molded plastic panels for covering building surfaces.

2. Description of the Related Art

Molded plastic siding panels for exterior building walls are known in the prior art. These molded panels are made from synthetic thermoplastic polymers, including polypropylene, polyethylene, and various mixtures and copolymers thereof.

Laterally elongated molded plastic panels are nailed to a wall support surface in horizontal rows partially overlapping each other in order to provide a pleasing appearance combined with a weather-resistant protective layer over the support surface.

The molded plastic panels are typically installed by securing several adjacent courses to a wall support surface, starting with a bottom course. A lower marginal edge region of each panel in courses above the bottom course overlaps a panel in the course immediately below. Side marginal edge regions of each panel overlap side marginal regions of adjacent panels.

Various mechanisms have been proposed for interlocking lower marginal edge regions of the plastic panels with panels in the course immediately below. Some of these methods include a locking tab extending forwardly and downwardly from the top of each panel, and a return leg extending upwardly and rearwardly from the bottom of each panel. As each panel is installed, the return leg of the panel being installed is interlocked with the locking tab of the panel below it, which has previously been installed. These interlocking components may require difficult and time consuming manufacturing processes.

U.S. Pat. No. 6,224,701, issued to D. A. Bryant, et al. on May 1, 2001, and assigned to the assignee of the present invention, discloses a molded plastic siding panel. This panel is molded with the nail hem formed from two mating components connected by a living hinge, and the locking tab projecting upward from the top of the panel. After molding, the living hinge of the nail hem is folded, and the two opposing components are secured to each other initially by rivets on one half fitting with an openings on the other half. The two halves are then thermally or ultrasonically joined together. While this process has been found to produce a siding panel of high quality and which is easy to install, a simplified manufacturing process, having a reduced number of steps, is desired.

SUMMARY OF THE INVENTION

The present invention provides a thermoplastic panel for covering building surfaces that is simpler to produce than conventional panels. The method of the present invention can be used to produce panels for a variety of applications including exterior walls, roofs, soffits and the like. In a preferred embodiment, the panel includes a body with an attachment hem and locking tab adjacent to the upper portion of the body, and a return leg attached to the bottom of the body.

The panel is injection molded in a manner that permits it to be withdrawn from the mold in a shape that is very close to the final shape of the panel, with the attachment hem already completely formed, and the locking tab close to its final position. Pressure is applied to the locking tab as it cools, bringing it closer to the panel, so that when it is fully solidified, it is within its final, desired position.

The use of this injection molding method eliminates the need to form a hinge within the nail hem, fold the nail hem, and then attach the opposing portions of the nail hem together, after injection molding the panel.

BRIEF DESCRIPTION OF THE DRAWINGS

Like reference characters denote like elements throughout the drawings.

DETAILED DESCRIPTION OF THE PREFERRED EMBODIMENTS

The present invention is directed toward an improved molded plastic panel for covering building surfaces. While the following description refers to an embodiment directed to a wall panel, the invention is applicable to other building surfaces such as walls roofs and soffits for example.

Figure 1:
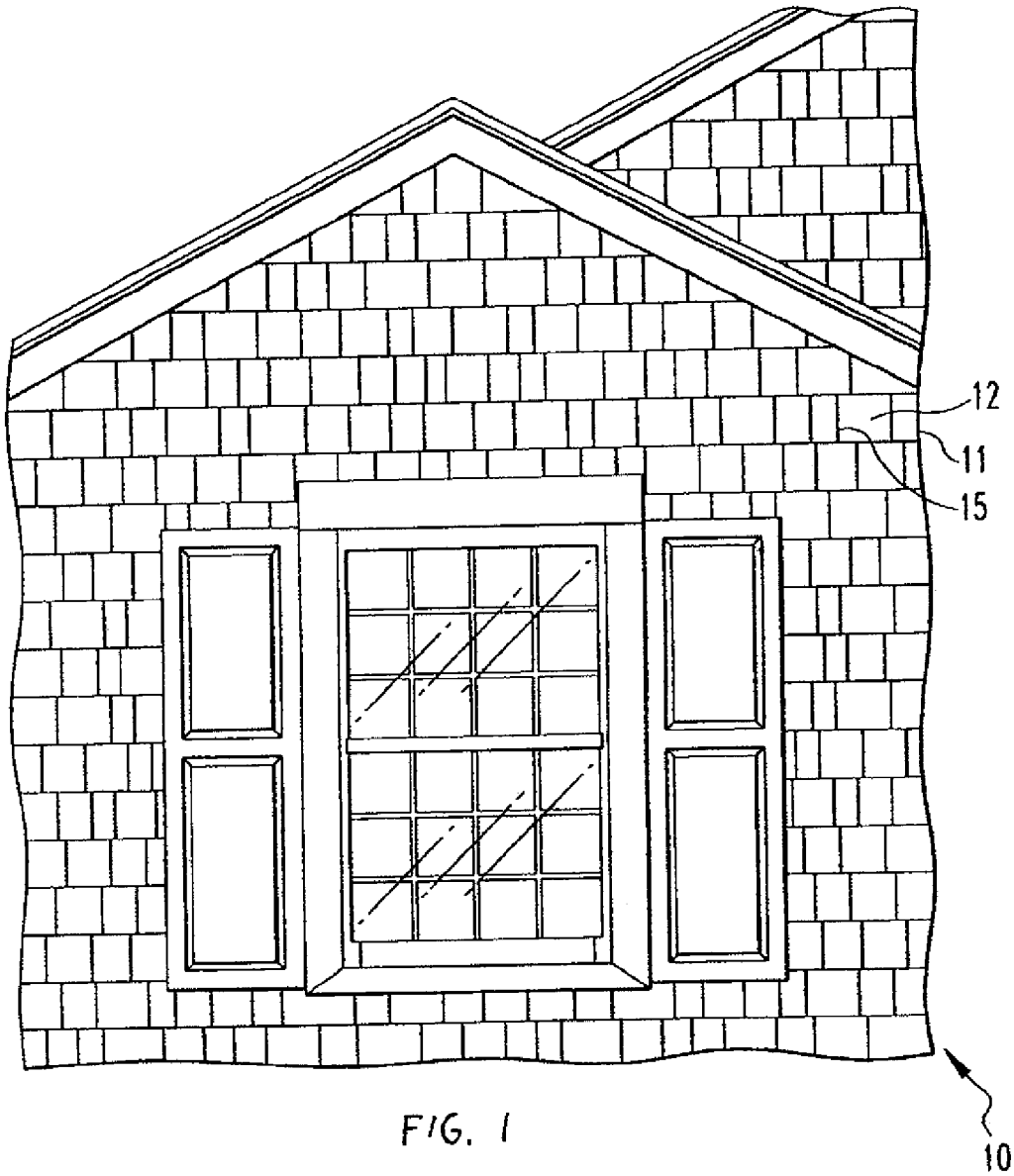
FIG. 1 is a fragmentary front elevational view of a building wall covered with plastic panels made in accordance with the present invention.

Referring to FIG. 1, an exterior wall 10 is covered by several plastic panels 11. The panels 11 each include three laterally extending, generally parallel rows of simulated wood shingles 12, but the number of rows may vary. The shingles 12 preferably have irregular widths, and are separated from shingles in the same row by vertically extending gaps 15 of varying widths. The panels 11 may cover an entire exterior wall as shown in FIG. 1, or they may be combined with other exterior wall coverings.

Figure 2:
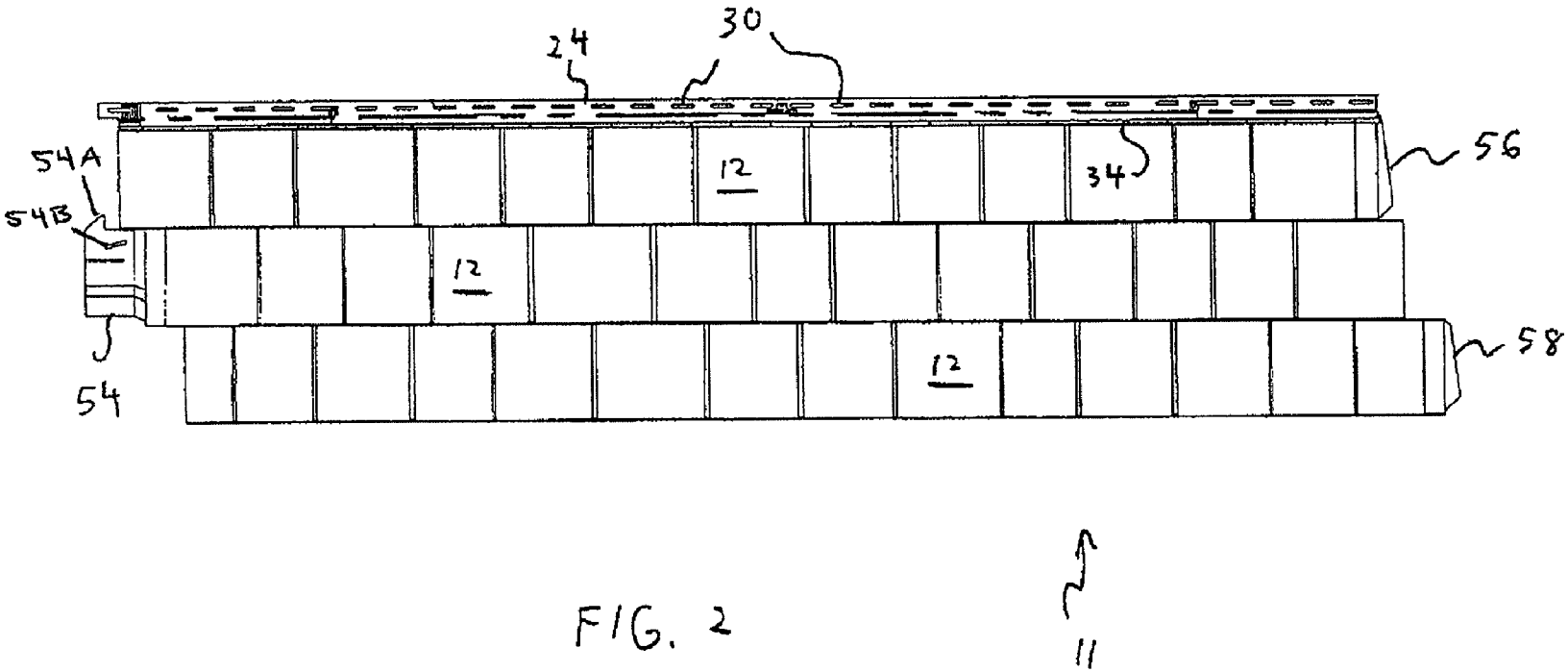
FIG. 2 is a front elevational view of a plastic siding panel according to the present invention.
Figure 3:
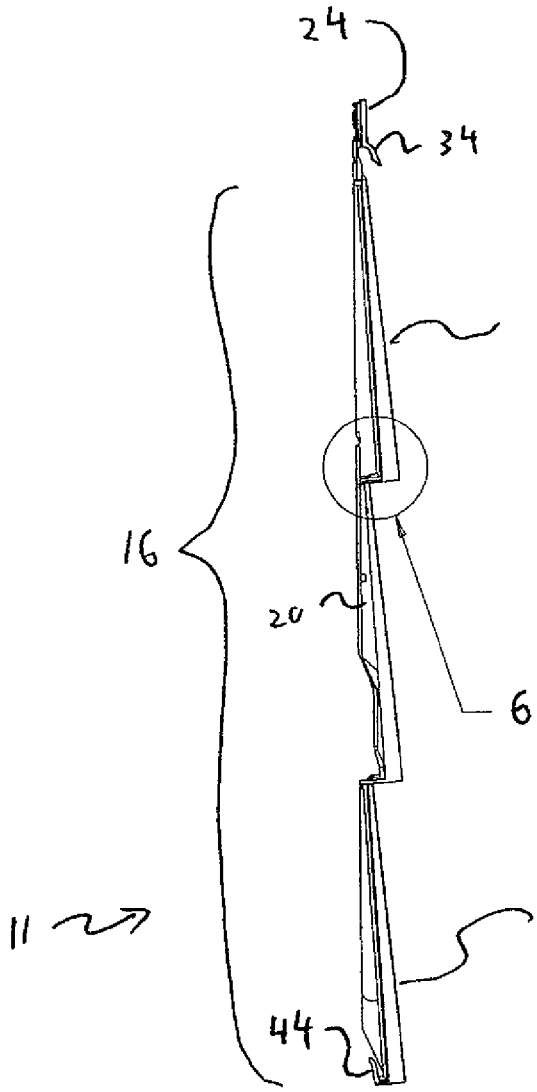
FIG. 3 is a left side elevational view of a plastic siding panel according to the present invention.
Figure 4:
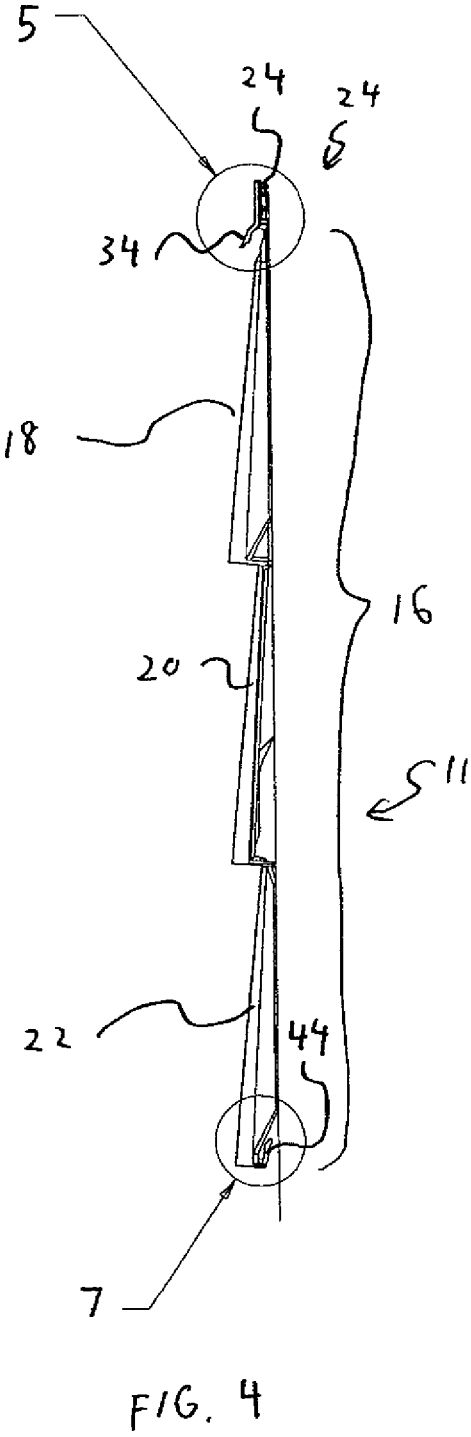
FIG. 4 is a right side elevational view of a plastic siding panel according to the present invention.

Referring to FIGS. 2-4, one of the panels 11 is shown in greater detail. The panel 11 includes a body 16 divided into a plurality of generally parallel, laterally extending rows, with three rows 18, 20, 22 present in the illustrated example. The gaps 15 between the shingles 12 have widths that vary randomly within predetermined limits in order to camouflage spacings between adjacent panels accompanying thermal contraction and expansion.

Figure 5:
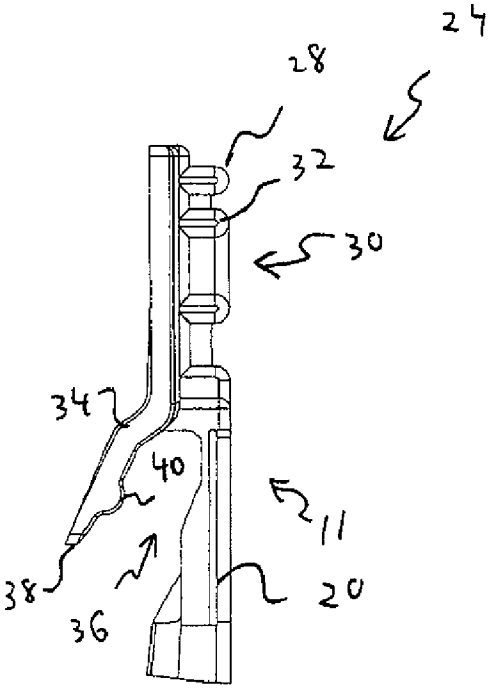
FIG. 5 is a side elevational view of Detail 5 in FIG. 4.

Referring to FIGS. 3-5, an attachment hem 24 extends upward from the top of the body 16. The attachment hem 24 includes an attachment body 36 having a positioning rib 28 extending rearwardly therefrom. A plurality of nail holes 30, surrounded by rearwardly projecting reinforcing ribs 32, are defined within the attachment hem 24. The positioning rib 28, and nail hole reinforcing ribs 32, are dimensioned to permit the entire panel 11 to fit flat against the side of a wall 10.

A locking tab 34 extends downward and slightly outward from the attachment body 16, defining a channel 36 between itself and the body 16. The locking tab 34 extends substantially across the entire top of the panel 11. The locking tab 34 includes a tapered nose 38 and the locking rib 40 projecting into the channel 36.

Figure 6:
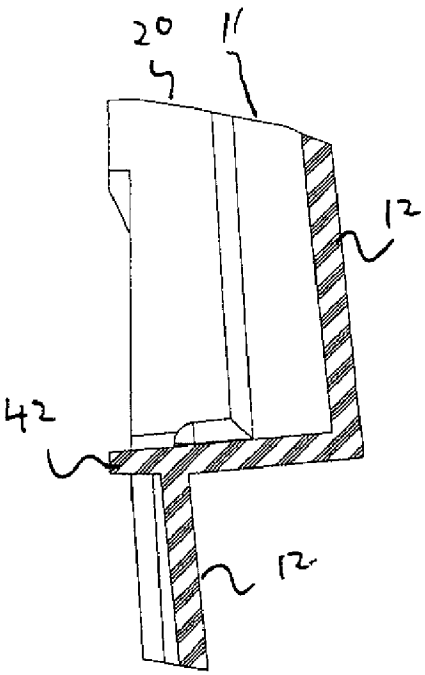
FIG. 6 is a side elevational view of Detail 6 in FIG. 3.

Referring to FIGS. 3 and 6, a locating ridge 42 projects rearwardly from the intersection of the upper and middle rows 18 and 20, respectively.

Figure 7:
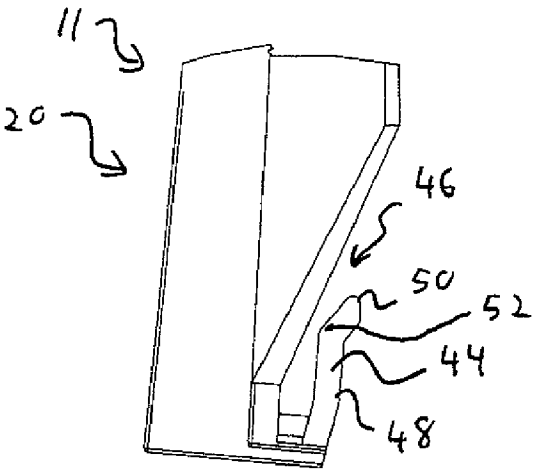
FIG. 7 is a side elevational view of Detail 7 in FIG. 4.

Referring to FIGS. 4 and 7, the bottom of the body 16 includes a return leg 44 extending upward and rearward therefrom. The return leg 44 defines a channel 46 between itself and the body 20. The return leg 44 includes a base portion 48 and a tip portion 50, with an obtusely angled corner 52 defined therebetween.

The panel 11 is preferably made from a thermoplastic polymer selected from the group consisting of polyolefin, polycarbonate, polyvinyl chloride, and mixtures and copolymers thereof. Polyolefins, especially polypropylene and mixtures and copolymers with polyethylene, are particularly preferred.

The panel 11 is manufactured by injection molding. The mold includes an elongated member structured to fit under that portion of the plastic that will become the locking tab 34, and which takes up the space of the channel 36. As the opposing molds portions are withdrawn from a panel 11, the piece taking up the space of the channel 36 will be moved downward with respect to the panel 11, out of the channel 36, prior to or during removal of the mold portion from the panel 11. At this point, the panel 36 is wider than desired, but the plastic will still be warm and flexible. Downward and inward pressure applied to the locking tab 34 will cause it to cool and solidify in the desired position.

Referring to FIG. 2, the left side of the panel 11 includes an outwardly extending fin 54, extending from the middle row 20. Similarly the right side of the panel 11 includes a pair of outwardly extending fins 56, 58 extending from the upper row 18 and lower row 22, respectively. The fins 54, 56, 58 extend slightly rearwardly, so that they will nestle underneath adjacent panels. As further shown by FIG. 2, fin 54 includes an upwardly extending flange 54A. Diagonal nail slot 54B is disposed at a slant to compensate for both horizontal and vertical loads from adjacent panels thermal expansion and contraction as well as wind loads.

To install the panels 11 on a wall 10, a starter strip is first attached to the wall along its lower edge, in a manner well known in the art of siding installation, as described in U.S. Pat. No. 6,224,701, owned by the assignee of this invention, and expressly incorporated herewith. The starter strips include a downwardly opening groove structured to receive the return leg 44 of the lowermost row of panels 11. With the return leg 44 secured within the starter strip, a panel is secured in place. The engagement of the return leg 44 and starter strip is structured to permit horizontal expansion and contraction of the panel. The upper portion of each panel 11 is secured by driving fasteners through the nail holes 30 and into the wall 10. The holes 30 are preferably elongated to permit expansion and contraction of the panel 11 without buckling. Horizontally adjacent panels 11 are installed with the flange 54 of one panel inserted between the adjacent flanges 56, 58 of the adjacent panel, thereby resisting vertical movement of one horizontally adjacent panel with respect to another, while permitting horizontal movement due to thermal expansion and contraction. The varying widths of the gaps 15 make it more difficult to determine the locations of the joints between adjacent panels, regardless of thermal expansion and contraction.

Once the lowermost row of panels 11 is installed, the next row of panels is installed by inserting the return legs 44 underneath the locking tabs 34, thereby securing the next row of panels to the row of panels below it. Horizontally adjacent panels are joined in the same manner as horizontally adjacent panels in the previous row. Fasteners are again driven through the holes 30 within the attachment hem 24 to secure the upper edge of the panel to the wall 10. The process continues until a desired portion of the wall 10 is covered with panels 11.

The present invention therefore provides a molded panel having a continuous locking tab along its top edge, extending between the sides of the panel without any openings or spaces therein. Such a continuous tab facilitates connecting the panel with a vertically adjacent panel. The panel may be made by a simplified manufacturing procedure, having fewer steps.

While specific embodiments of the invention has been described in detail, it will be appreciated by those skilled in the art that various modifications and alternatives to those details could be developed in light of the overall teachings of the disclosure. For example, panels produced in accordance with the method of the present invention can be used as roofing panels and in soffits. Accordingly, the particular arrangements disclosed are meant to be illustrative only and not limiting as to the scope of the invention which is to be given the full breadth of the appended claims and any and all equivalents thereof.

We claim:

1. A panel for attachment to a building surface, the panel comprising:

a body;

at least two rows of features extending longitudinally across the body, the at least two rows of features terminating in longitudinally opposed first and second ends;

fins extending outwardly from the opposed first and second ends in an alternating fashion between rows, the fins of the first and second ends extending slightly rearwardly in order to nestle beneath adjacent panels, the fin of the first end including:

a) a diagonally oriented nailing slot to facilitate securement of the panel to the building surface, and b) an upwardly extending flange;

an attachment hem and a locking tab, the attachment hem and the locking tab extending longitudinally across the body, the locking tab including an integral locking rib, the attachment hem and locking tab both adjacent an upper portion of the body; and a return leg extending longitudinally across the body, the return leg including an angled corner, the return leg adjacent a base portion oppositely disposed from the upper portion of the body, the angled corner of the return leg of a first body configured to securely engage the locking rib of the locking tab of a second body wherein the second body is disposed above the first body on the building surface.

2. The panel of claim 1, wherein the locking tab is continuous.

3. The panel of claim 1 wherein the at least one row of features comprises an upper row of simulated shingles and a lower row of simulated shingles below the upper row.

4. The panel of claim 3, wherein at least one of the lower and the upper row of simulated shingles is irregularly spaced.

5. The panel of claim 1, wherein the fin defines a fastening slot for inserting a fastener therethrough to attach the panel to a building wall, wherein the slot extends at an acute angle of between 5 and 30 degrees relative to horizontal.

6. The panel of claim 1, wherein the panel comprises exterior wall siding.

7. The panel of claim 1, wherein the panel comprises a roofing panel.

8. The panel of claim 1, wherein the return leg further comprises an angled corner and a tip portion wherein a longitudinally extending channel is formed between the body and the return leg.

9. The panel of claim 8, wherein the channel of a first panel is configured to receive the locking tab of a second channel disposed on a panel disposed beneath the first panel.

10. A panel for attachment to a building surface, the panel comprising:

a body including at least two courses of features extending longitudinally across the body on a first side of the body, the at least two courses of features having longitudinally disposed first and second ends;

fins extending outwardly from the opposed first and second ends in an alternating fashion between rows, the fins of the first and second ends extending slightly rearwardly in order to nestle beneath adjacent panels, the fin of the first and second ends extending slightly rearwardly in order to nestle beneath adjacent panels, the fin of the first end including:

a) a diagonally oriented nailing slot to facilitate securement of the panel to the building surface to compensate for thermal expansion and contraction as well as windloads from adjacent panels, and b) an upwardly extending flange;

an attachment hem adjacent an upper portion of the body;

a continuous locking tab with a locking rib and tapered nose, the continuous locking tab, locking rib and tapered nose extending longitudinally across the entire body, the locking tab extending outwardly from the body forming a channel between the locking tab and the body;

a locating ridge disposed opposite the first side of the body; and a return leg disposed laterally opposite the locking tab on the body, the return leg including an angled corner forming the narrowest gap between the return leg and the body, the return leg of a first body configured to securely receive the locking tab of a second body wherein the second body is disposed above the first body on the building surface.

* * * * *